US008376432B1

(12) United States Patent
Hagler et al.

(10) Patent No.: US 8,376,432 B1
(45) Date of Patent: Feb. 19, 2013

(54) IMPELLER JIG

(75) Inventors: Benjamin L. Hagler, Martinez, GA (US); William Henry Lavery, III, Augusta, GA (US); Joey Glenn Lloyd, Evans, GA (US)

(73) Assignee: Hagler Systems, Inc., North Augusta, SC (US)

( * ) Notice: Subject to any disclaimer, the term of this patent is extended or adjusted under 35 U.S.C. 154(b) by 163 days.

(21) Appl. No.: 12/897,118

(22) Filed: Oct. 4, 2010

(51) Int. Cl.
*B66C 1/00* (2006.01)

(52) U.S. Cl. ..... 294/67.22

(58) Field of Classification Search ..... 294/67.2, 294/67.21, 67.22, 67.5, 81.3; 440/38; 269/143, 269/249
See application file for complete search history.

(56) References Cited

U.S. PATENT DOCUMENTS 2,329,008 A * 9/1943 Smith ..... 294/67.5
4,475,758 A * 10/1984 Paulsson ..... 294/67.21
4,773,688 A * 9/1988 Jones ..... 294/67.22
5,071,183 A * 12/1991 McDermott et al. ..... 294/67.2
5,405,210 A * 4/1995 Tsui ..... 403/119
5,445,426 A * 8/1995 Sorensen ..... 294/67.3
5,688,009 A * 11/1997 Pienta ..... 294/67.2

OTHER PUBLICATIONS

GIW CE Manual, 2007, pp. 1-34.
GIW Industries, History, 2pp. 2009.
GIW Industries, ICC Slurry Pumps, 2008, 2009, 1 p.

* cited by examiner

*Primary Examiner* — Dean Kramer
*Assistant Examiner* — Stephen Vu
(74) *Attorney, Agent, or Firm* — MacCord Mason PLLC

(57) ABSTRACT

An impeller jig for lifting and positioning an impeller having a shaft bore in a pump. The impeller jig includes a frame, a lifting aperture attached to the upper end of the frame and a lifting point attached to the opposed end of the frame adapted to engage the shaft bore of the impeller. A pair of opposed jacks are attached to the opposed end of the frame and adapted to engage at least two opposed outer surfaces of the impeller adjacent to the shaft bore of the impeller thereby forming a stability triangle with the lifting point. Also, the impeller jig may further include a positioning weight adjacent to the lifting aperture for transferring the center of gravity of the impeller jig upwardly and sufficiently close to the lifting vertical centerline to permit the impeller jig to be positioned for engaging the impeller by the operator prior to lifting.

20 Claims, 11 Drawing Sheets

IMPELLER JIG

BACKGROUND OF THE INVENTIONS (1) Field

The present inventions relate generally to lifting jigs and, more particularly, to an improved impeller jig for lifting and positioning an impeller for installation, removal or adjustment in a pump.

(2) Related Art

Among the various types of fluid machinery, pumps that convert mechanical energy into fluid energy, and turbines that convert fluid energy into mechanical energy are beneficial and well exploited to meet a variety of flow-pattern demands. The adaptability and flexible features of pumps and turbines are particularly advantageous for both commercial and residential construction, machinery, construction repair and the like. The centrifugal pump is a popular choice for handing liquids, semi-solid slurry, solids or other types of flow. Typically, flow enters the centrifugal pump along a rotating axis and is then accelerated by a rotating element, e.g. an impeller, causing flow radially outward or axially. The impeller may be generally sized and shaped in a variety of arrangements to force the flow outward in a plane against its axis to provide a specific velocity or to induce a spiral flow.

Centrifugal flow pumping stations include single-stage pumps, multi-stage pumps and a combination thereof. Typically, a single stage pump houses a single impeller, whereas multistage systems have a plurality of impellers arranged with the discharge of one pump in fluid communication with another impeller. Therefore, proper impeller alignment and arrangement in centrifugal pumps is advantageous, and often necessary, for the pump(s) to operate at desired efficiency. However, impeller installation, removal or adjustment is often a difficult and unpredictable procedure. It is often difficult and nearly impossible to align and engage an impeller in plane with a pump due to insufficient clearances or an ineffective moment arm.

Thus, there remains a need for a new and improved impeller jig which is adjustable to lift and position impellers having a great variety of sizes and shapes while, at the same time, is adapted to permit the impeller jig to be more easily positioned for engaging the impeller by the operator prior to lifting.

SUMMARY OF THE INVENTIONS

The present inventions are directed to an impeller jig for lifting and positioning an impeller having a shaft bore in a pump. The impeller jig includes a frame, a lifting aperture attached to the upper end of the frame and a lifting point attached to the opposed end of the frame adapted to engage the shaft bore of the impeller. The lifting aperture and the lifting point define a lifting vertical centerline extending from the lifting aperture to the lifting point. A pair of opposed jacks are attached to the opposed end of the frame and adapted to engage at least two opposed outer surfaces of the impeller adjacent to the shaft bore of the impeller thereby forming a stability triangle with the lifting point. In one embodiment, the pair of opposed jacks are adjustable with respect to the lifting vertical centerline of the impeller jig. Also, the impeller jig may further include a positioning weight adjacent to the lifting aperture for transferring the center of gravity of the impeller jig upwardly and sufficiently close to the lifting vertical centerline to permit the impeller jig to be positioned for engaging the impeller by the operator prior to lifting.

In one embodiment, the frame is formed by a semi-box construction. The semi-box construction may include a pair of parallel side plates attached to one another by tie-ins to resist buckling, the pair of parallel side plates forming the lifting point.

Also, in one embodiment, the lifting aperture is a lifting eye. The lifting eye may include a hoist ring and a fastener for attaching the hoist ring to the frame. The hoist ring may be a swivel hoist ring. Also, the fastener may be an adjustable position fastener for moving the hoist ring in the vertical lifting plane of the impeller jig thereby moving the lifting vertical centerline. The impeller jig may further include a marking plate adjacent to the adjustable position fastener for indicating pre-determined positions to move the hoist ring in the vertical lifting plane of the impeller jig for specific impellers prior to lifting.

In one embodiment, the opposed end of the frame adjacent to the lifting point may further include a stationary pivot point. The stationary pivot point and the pair of opposed jacks located adjacent to the lifting point may be adapted to position the vertical plane of the impeller substantially perpendicular to the axis of the pump shaft bore.

The pair of opposed jacks may include a pair of opposed arms and a pair of jacking bolts. In one embodiment, the pair of opposed arms are adapted to provide lateral adjustment of the pair of jacking bolts with respect to the lifting vertical centerline. The pair of opposed arms may be slotted to provide lateral adjustment of the pair of jacking bolts. Also, the pair of jacking bolts may further include shoulder tooling bars on the ends of the jacking bolts proximate to the outer surfaces of the impeller.

In one embodiment, the positioning weight is located between the lifting vertical centerline and the impeller. Preferably, the amount of the positioning weight is a function of a weight of the impeller jig according to the following function—Maximum Applied Force equals $((M)(W_j*G)(\text{Sin}(\text{theta})))/(G_h)$ where M is the correcting moment, $W_j$ is the weight of the impeller jig, G is the gauge distance, theta is the desired angle or repose, and $G_h$ is the handle gauge distance. Also, preferably, the Maximum Applied Force is about forty-five pounds and the angle of repose is about ten degrees.

The impeller jig may further include at least one positioner chosen from a grip defined by a cavity in the frame and at least one guiding bar secured on the frame, whereby the positioner is adapted to position the impeller jig with respect to the impeller prior to lifting the impeller. Preferably, the impeller jig includes a pair of guiding bars located on the opposite side of the frame from the impeller for positioning the impeller jig with respect to the impeller prior to lifting the impeller wherein one of the pair of guiding bars is located near the lifting point and the other of the pair of guiding bars is located above the lifting point.

The impeller jig may also further include a positioning bar located adjacent to the lifting point and on the opposite side of the frame from the impeller, whereby the positioning bar horizontally positions the lifted impeller with respect to the pump shaft bore. In one embodiment, the positioning bar is generally semi-circular and extends from one of the pair of opposed jacks located adjacent to the lifting point to the other of the pair of opposed jacks.

Accordingly, one aspect of the present inventions is to provide an impeller jig for lifting and positioning an impeller having a shaft bore in a pump, the impeller jig including a frame; a lifting aperture attached to the upper end of the frame; a lifting point attached to the opposed end of the frame adapted to engage the shaft bore of the impeller, the lifting aperture and the lifting point defining a lifting vertical centerline extending from the lifting aperture to the lifting point; and a pair of opposed jacks attached to the opposed end of the frame and adapted to engage at least two opposed outer surfaces of the impeller adjacent to the shaft bore of the impeller thereby forming a stability triangle with the lifting point.

Another aspect of the present inventions is to provide an impeller jig for lifting and positioning an impeller having a shaft bore in a pump, the impeller jig including a frame; a lifting aperture attached to the upper end of the frame; a lifting point attached to the opposed end of the frame adapted to engage the shaft bore of the impeller, the lifting aperture and the lifting point defining a lifting vertical centerline extending from the lifting aperture to the lifting point; and a pair of opposed jacks attached to the opposed end of the frame and adapted to engage at least two opposed outer surfaces of the impeller adjacent to the shaft bore of the impeller thereby forming a stability triangle with the lifting point and wherein the pair of opposed jacks are adjustable with respect to the lifting vertical centerline of the impeller jig.

Still another aspect of the present inventions is to provide an impeller jig for lifting and positioning an impeller having a shaft bore in a pump, the impeller jig including a frame; a lifting aperture attached to the upper end of the frame; a lifting point attached to the opposed end of the frame adapted to engage the shaft bore of the impeller, the lifting aperture and the lifting point defining a lifting vertical centerline extending from the lifting aperture to the lifting point; a pair of opposed jacks attached to the opposed end of the frame and adapted to engage at least two opposed outer surfaces of the impeller adjacent to the shaft bore of the impeller thereby forming a stability triangle with the lifting point and wherein the pair of opposed jacks are adjustable with respect to the lifting vertical centerline of the impeller jig; and a positioning weight adjacent to the lifting aperture for transferring the center of gravity of the impeller jig upwardly and sufficiently close to the lifting vertical centerline to permit the impeller jig to be positioned for engaging the impeller by the operator prior to lifting.

These and other aspects of the present inventions will become apparent to those skilled in the art after a reading of the following description of the embodiments when considered with the drawings.

DESCRIPTION OF THE PREFERRED EMBODIMENTS

Figure 1:
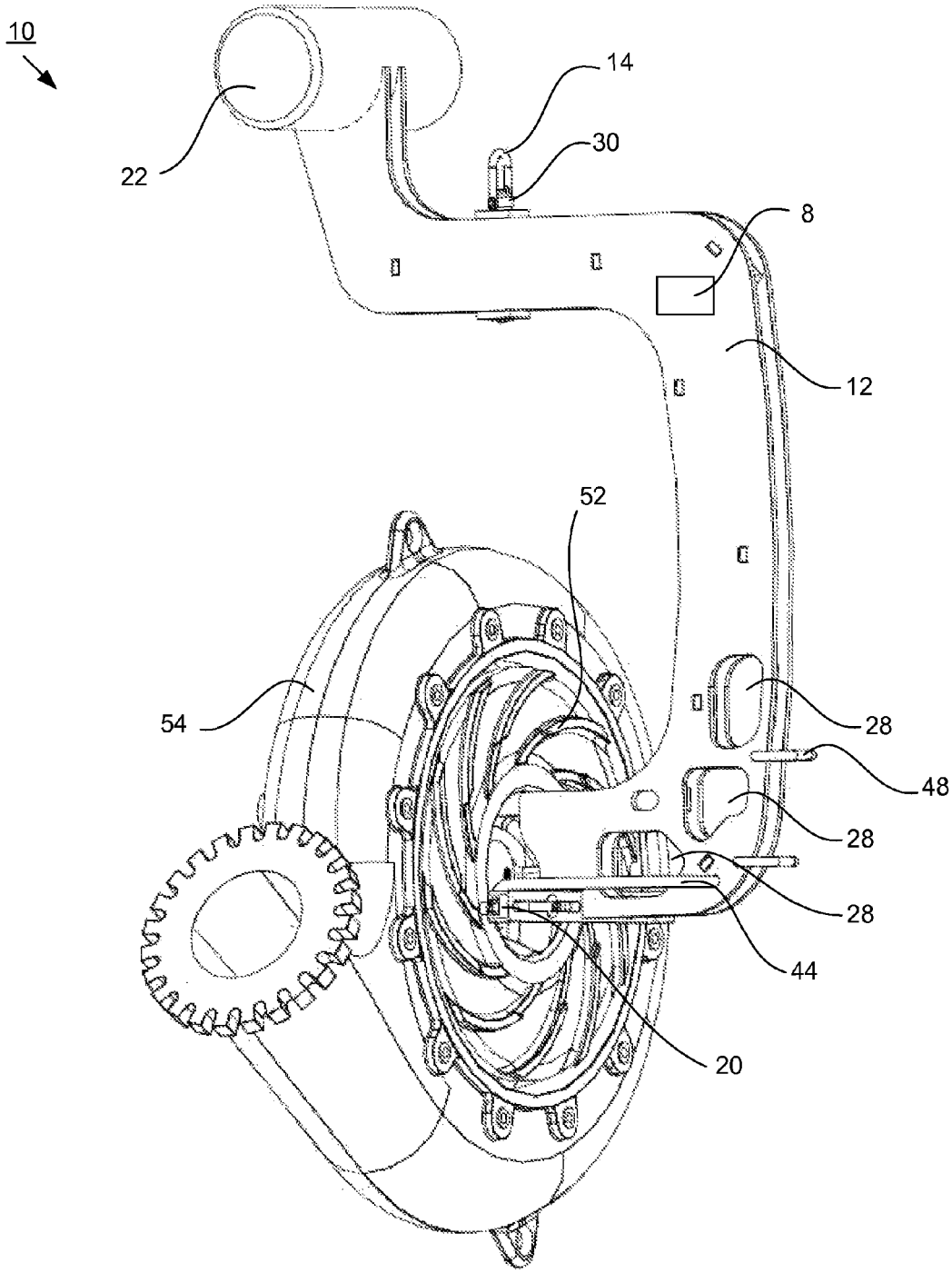
FIG. 1 is a side-perspective view of an impeller jig constructed according to the present inventions positioned within a centrifugal pump according to one embodiment of the present inventions.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 3:
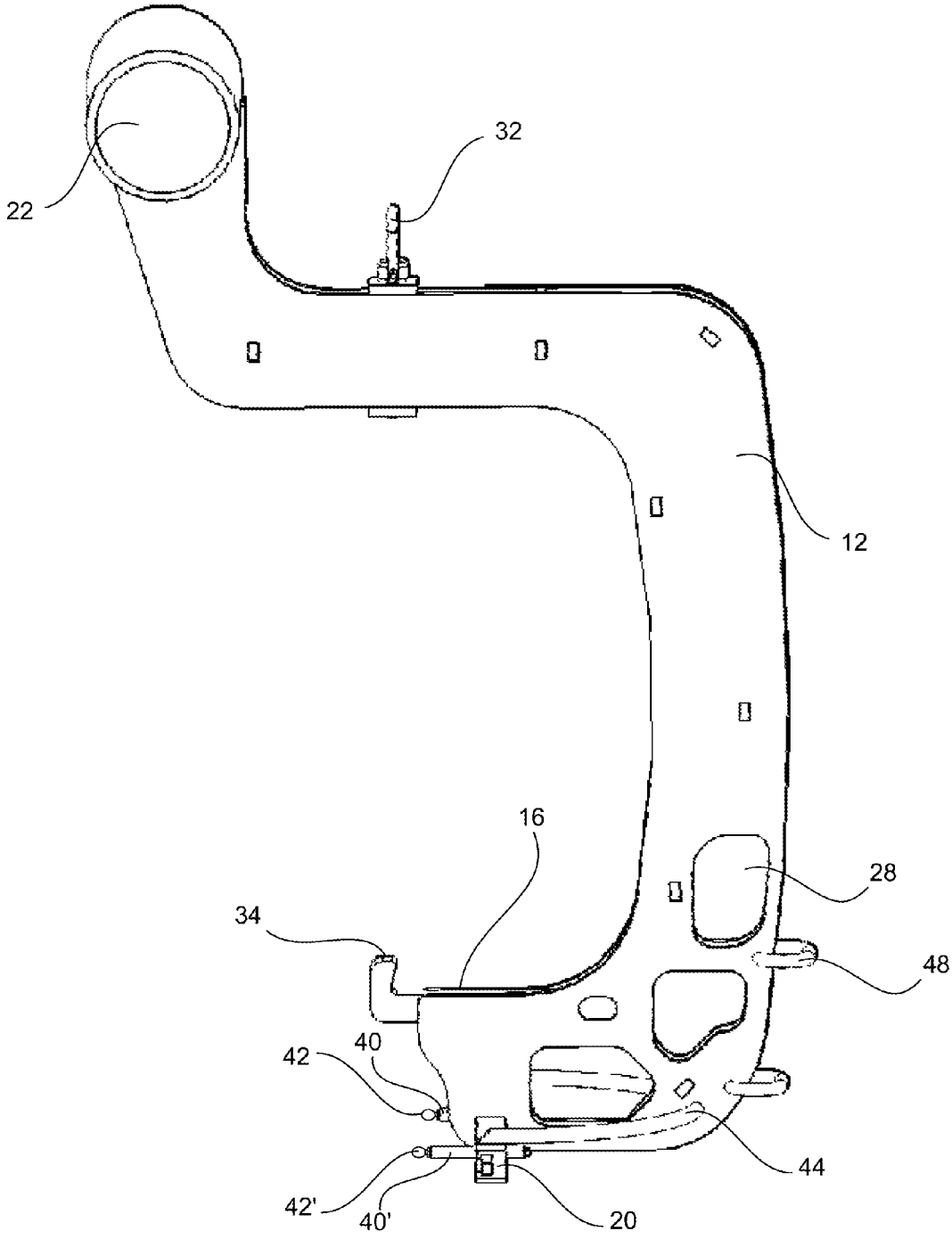
FIG. 3 is a side view of the embodiment of FIG. 1.
Figure 4:
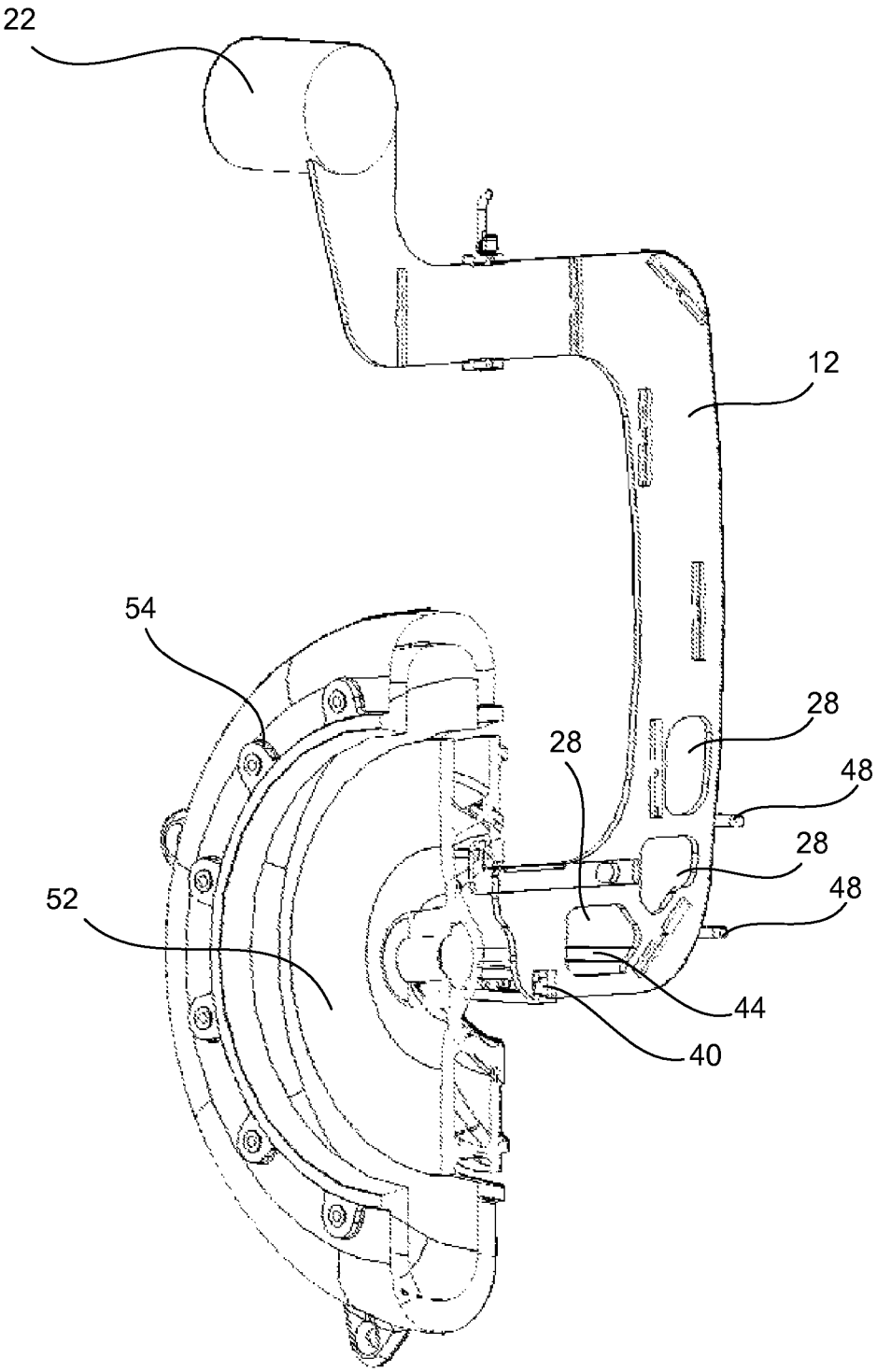
FIG. 4 is a cross-sectional view of the embodiment of FIG. 1.

Referring now to the drawings in general and FIG. 1 in particular, it will be understood that the illustrations are for the purpose of describing embodiments of the present inventions and are not intended to limit the invention thereto. As best seen in FIGS. 1 and 3, an impeller jig, generally designated 10, is shown constructed according to the present inventions and positioned within an impeller 52. Impeller jig 10 includes a frame 12 having a lifting aperture, such as a lifting eye 14, attached to one end of the frame 12, and a lifting point 16 on the opposing end of the frame 12. Typically, the impeller jig 10 includes a pair of opposed jacks 20, 20' aligned on the frame to form a stability triangle with the lifting point 16.

As shown in FIG. 1, the impeller jig 10 is configured for lifting and positioning an impeller 52 within a pump 54, for example on a pump shaft. In particular embodiments, pump 54 is a slurry or solids pump. However, the impeller jig 10 can also be used in other situations where similar lifting and positioning of an impeller, propeller or a similar load is desired.

Figure 6:
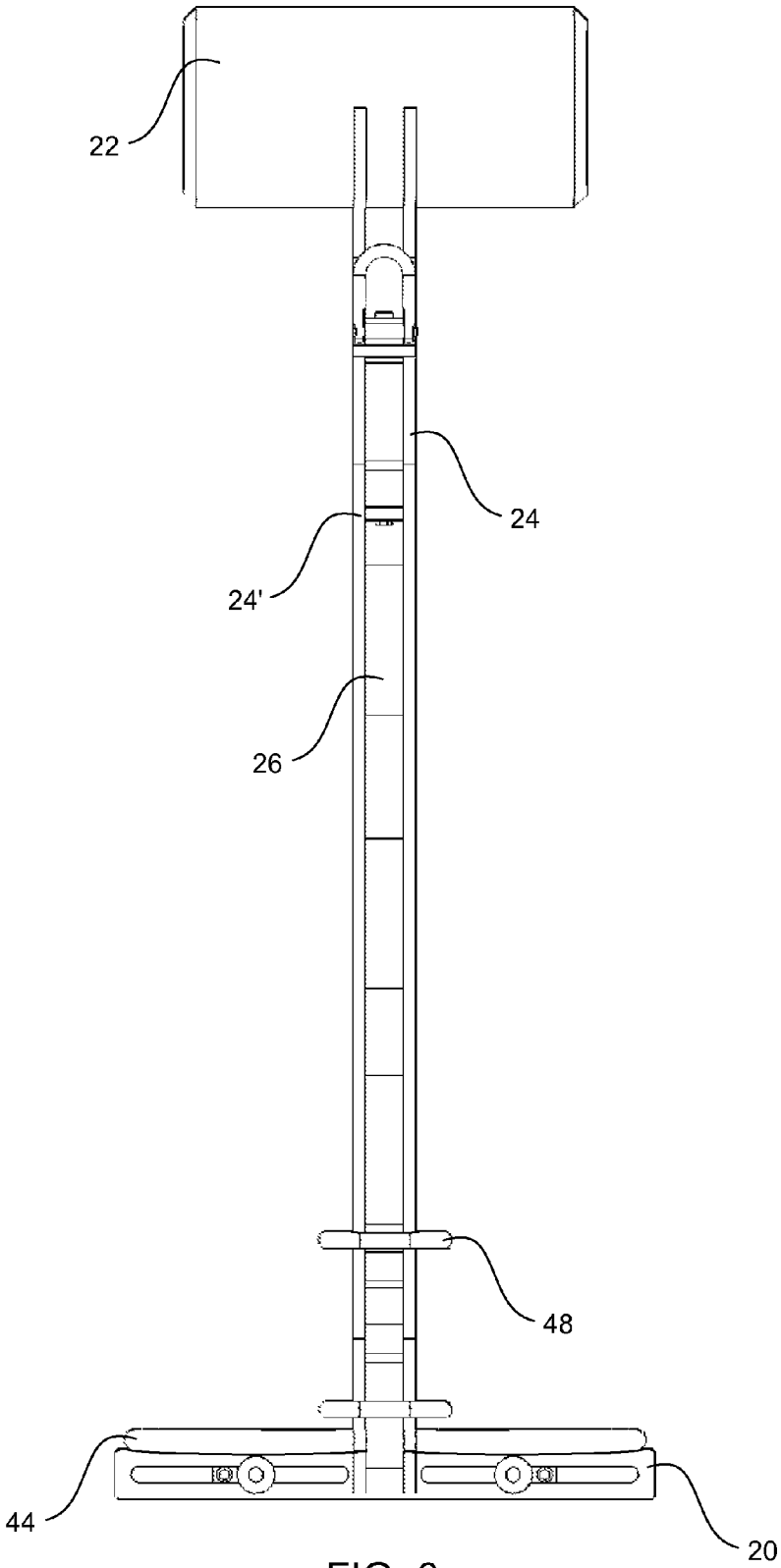
FIG. 6 is a rear view of the embodiment of FIG. 1.

As illustrated in FIG. 1, the frame 12 is generally shaped and arranged as a below-the-hook lifting device for attaching loads, e.g. an impeller 52, to a lifting machine, hoist or the like to lift and position the impeller 52 in proper alignment with pump 54. In some embodiments, the frame 12 may be a semi-boxed or boxed construction having planes in at least two directions to provide pseudo-box torsional shape to prevent, or eliminate, buckling in frame 12. For example, as best seen in FIG. 6, a pair of parallel side plates 24, 24' may be attached to one-another by tie-ins 26 to further resist buckling. The tie-ins 26 may be random tie-ins. Other embodiments of frame 12 include single plate or solid construction, for example an I-beam or a lightweight fiber material. In yet other embodiments, the frame 12 may be have a tapered shape, i.e. a smaller diameter bottom with a larger diameter top, or vice versa.

Further, as best seen in FIGS. 1-4, particular embodiments of frame 12 may include a support neck on the upper end of frame 12 depending on the size of the pump 54 or other facility constraints, such as headroom height. Typically, these embodiments are configured to operate heavyweight loads, for example about five thousand pounds or more. The support neck may be integrally connected with frame 12, and positioned substantially vertically between the upper end of frame 12 and a positioning weight 22 to enhance performance characteristics of impeller jig 10, as discussed hereinafter.

Figure 7:
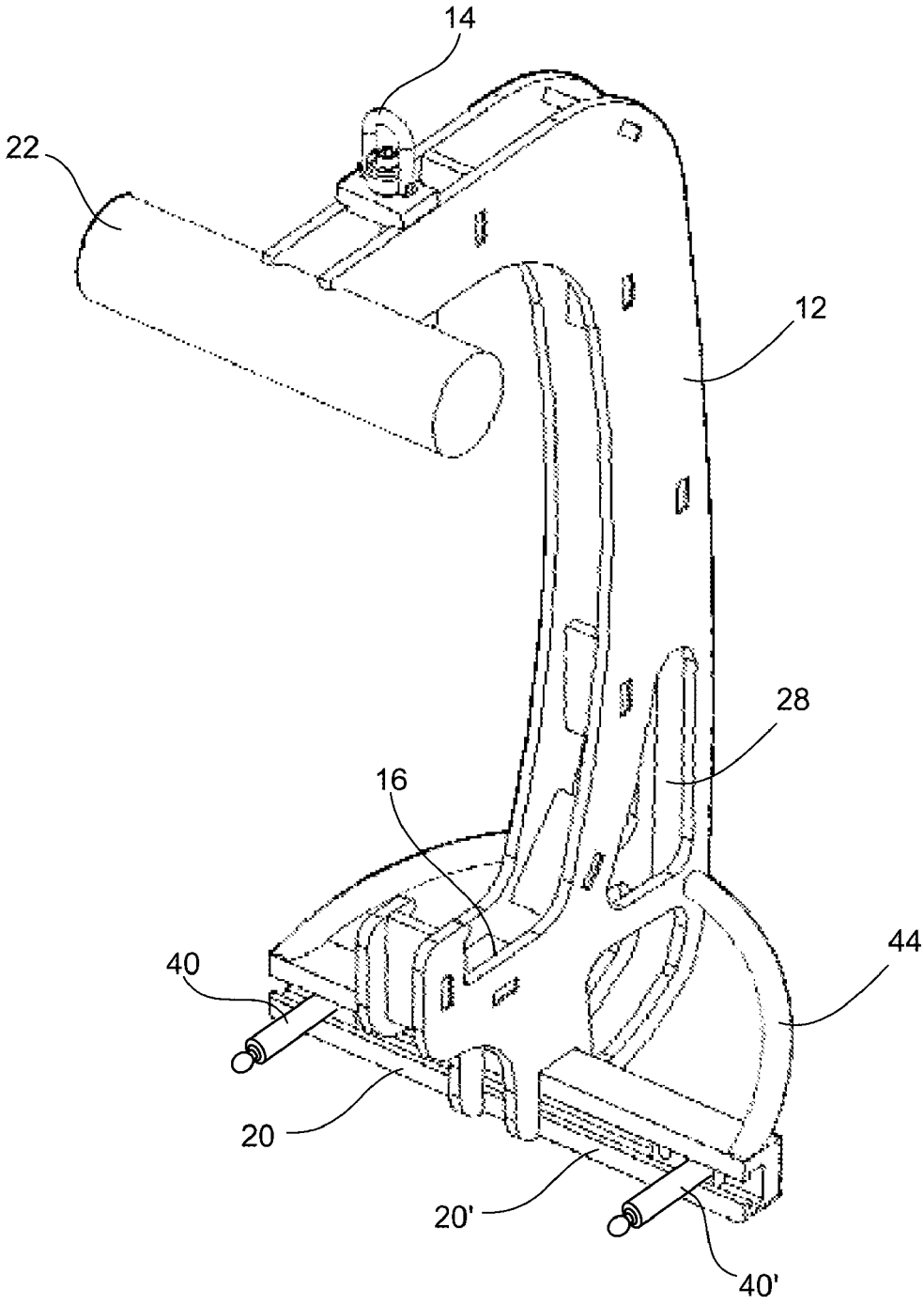
FIG. 7 is a side-perspective view of an impeller jig constructed according to another embodiment of the present inventions adapted to operate a variety of intermediate weight loads.

Other embodiments of a support neck also include a variety of angles, shapes and sizes in proportion to frame 12, including a substantially co-planar segment, as best seen in FIG. 7. Here, the co-planar alignment of the positioning weight 22 with the upper end of frame 12 may be used to operate intermediate loads, for example, about one thousand to about five thousand pounds. However, such embodiments may conveniently operate a variety of other loads. For example, the positioning weight's 22 size, height and location may depend on the type of impeller 52, the rated capacity of the jig 10 and/or other facility constraints, such as headroom height.

The frame 12 may further include a marking plate 8 affixed to impeller jig 10. For illustrative purposes only, the marking plate 8 may be fastened near the upper end of frame 12 to indicate pre-determined positions of impeller jig 10, including pre-determined positions of a hoist ring 30 in the vertical lifting plane, as described below. Typically, the marking plate 8 includes an impeller scale range to indicate a pre-determined position of the impeller jig 10 prior to lifting. In other exemplary embodiments, the frame 12 may include lighting holes, for example positioned near the lower end of frame 12.

The lifting aperture is generally attached to one end, for example the upper end, of frame 12 connecting the impeller jig 10 to a lifting machine, hoist or the like to lift (i.e. elevate or lower) the impeller jig 10, often at a predetermined restricted angle. For illustrative purposes only, the lifting aperture may restrict movement to specific angles, including about forty-five degree and substantially vertical lift.

Figure 8:
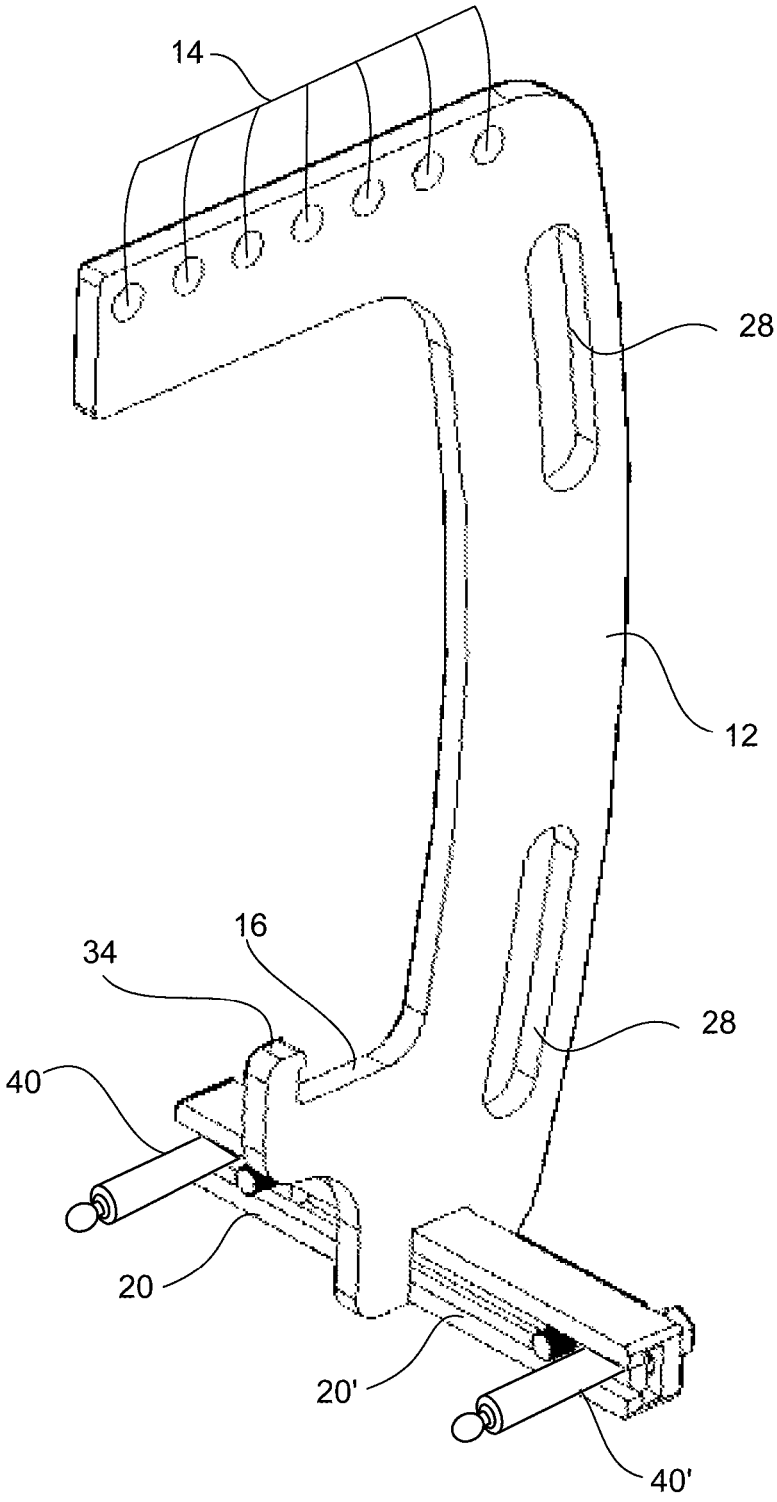
FIG. 8 is a side-perspective view of an impeller jig constructed according to another embodiment of the present inventions adapted to operate a variety of lightweight loads.

As seen in FIG. 8, the lifting aperture may be one, or a plurality of, cavities in the upper end of frame 12. Other embodiments of the lifting aperture include a lifting eye 14, for example as illustrated in FIGS. 1-7. For illustrative purposes only, the lifting eye 14 could be an eye nut, a swivel hoist ring, a shouldered hook, or the like. In other embodiments, the lifting aperture is a fixed eye. Further, the lifting aperture may include an adjustment mechanism. For example, a swivel hook embodiment may include an attachment for adjusting the jig on the vertical plane. A worm screw with a chain may be used to adjust the jig by engaging, i.e. pulling on, the chain.

Typically, the lifting eye 14 is rigid and includes a hoist ring 30 and fastener 32, as shown in FIG. 3, to secure the hoist ring 30 to the frame 12. In other embodiments, the hoist ring 30 is a swivel hoist ring, such as a Crosby swivel hoist ring, available from The Crosby Group Inc, 2801 Dawson Road, Tulsa, Okla. 74110. Typically, the fastener 32 is an adjustable position fastener to move the hoist ring 30 along a vertical lifting plane of the impeller jig 10. The movement of hoist ring 30 in turn adjusts the lifting vertical centerline, as described below. Other embodiments include a plate fastened to the upper end of frame 12 for connecting the impeller jig 10 to a lifting machine, hoist or the like. For example, the plate may be a single profile plate or a two side-plate profile.

Figure 10:
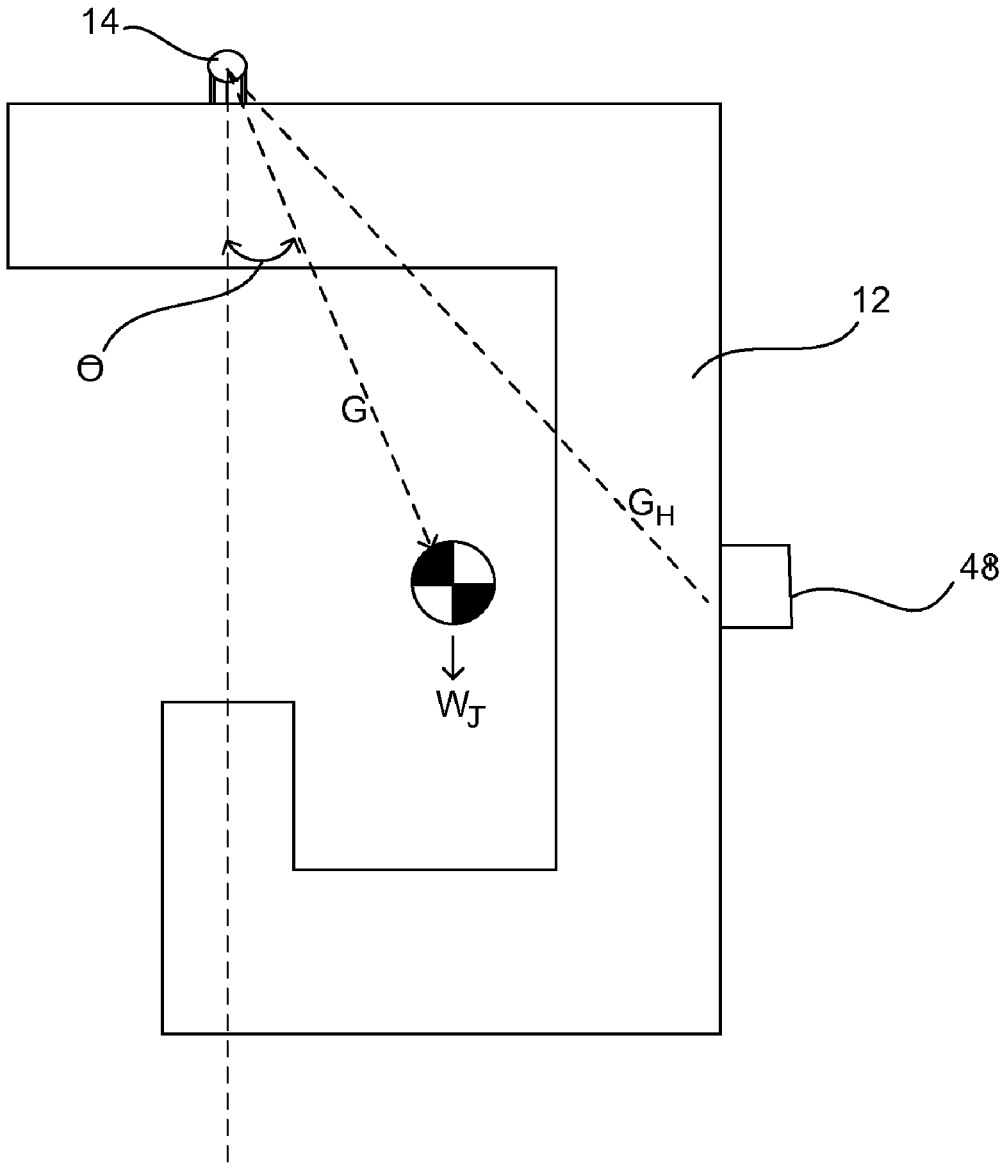
FIG. 10 is a schematic plan view of the Maximum Applied Force functions of embodiments of the inventions.

As shown in FIG. 3, the lifting point 16 on frame 12 is positioned on a distal end of the frame 12 as a receiving end for impeller 52, or a similar load. Typically, the lifting point 16 and lifting aperture 14 define the lifting vertical centerline, which generally extends between the lifting aperture 14 on the upper end of frame 12 to the lifting point 16 on the distal end of the frame 12, as illustrated in FIG. 10. Further, the lifting point 16 includes a stationary pivot point 34 adjacent to the lifting point 16 to provide additional control of the stability triangle between the opposed jacks 20, 20' and the lifting point 16. Typically, the stationary pivot point 34 and jacks 20, 20' position the centerline of the impeller 52 substantially perpendicular to the plane formed by the stationary pivot point 34 and the pair of jacks 20, 20'. The stationary pivot point 34 may be a variety of shapes, styles and sizes, including a solid, boxed, semi-boxed, or combination thereof design.

The pair of opposed jacks 20, 20' are generally positioned on opposed ends of frame 12 within the stability region adjacent to the lifting point 16 to bring the impeller jig 10 into plane with the outer surface of impeller 52 and pump 54. Typically, the jacks 20, 20' include a pair of opposed arms and a pair of jacking bolts 40, 40' to adjust the angle of impeller jig 10 to mach the pump's conditions, i.e. to engage at least two outer surfaces of the impeller 52 adjacent to a shaft bore of the impeller 52 to form the stability triangle with lifting point 16.

Figure 9:
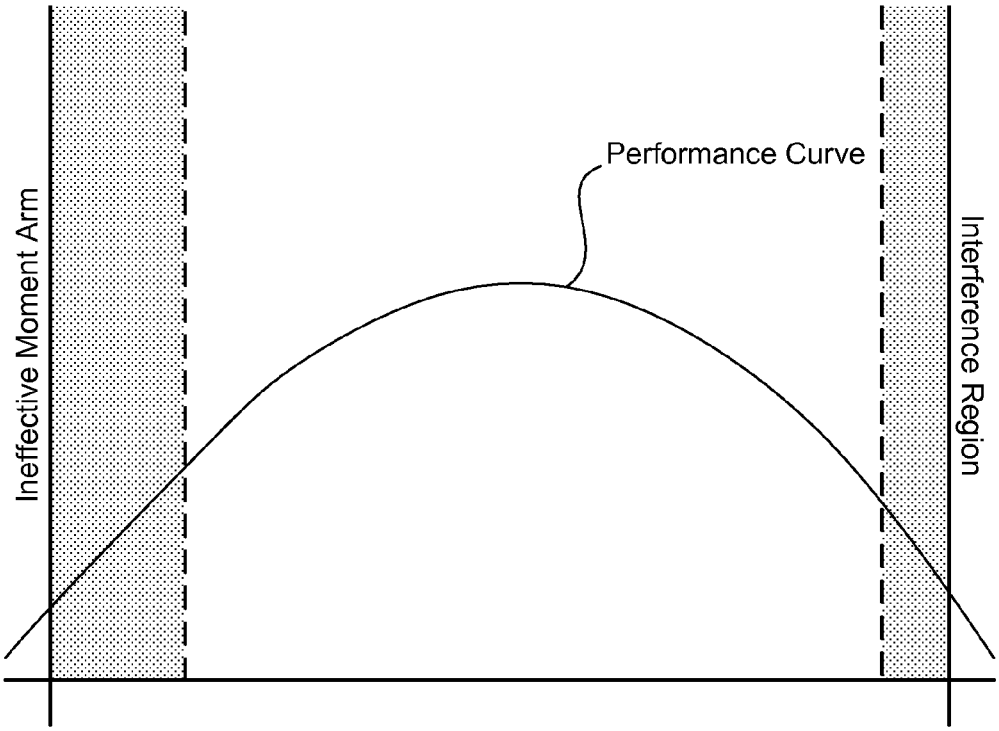
FIG. 9 is a graphical representation of the performance curve of any of the impeller jigs shown in FIG. 1, 7 or 8.

As illustrated in FIG. 9, the performance curve of the impeller jig 10 is a function of jig stability or mobility, usually within a range defined by an effective moment arm of the impeller jig 10 and an interference clearance region of the impeller jig 10.

Typically, the pair of opposed arms are adapted to permit adjustment, including lateral adjustment, of the jacking bolts 40, 40' with respect to the lifting vertical centerline. Therefore, the jacks 20, 20' engage at least two opposed outer surfaces of impeller 52 adjacent to the shaft bore of the impeller 52. In particular embodiments, the pair of opposed jacks 20, 20' will ensure that the impeller jig 10 remains perpendicular to the impeller 52, usually even if mishandled, while the lateral adjustment of the push point provides improved clearance below impeller jig 10. In particular embodiments, the pair of opposed arms are slotted, or otherwise holed, to permit the jacking bolts 40, 40' to be adjusted, e.g. laterally adjusted. Further, the pair of opposed arms may be a single plate which is configured to contact the impeller 52 without the jacking bolts 40, 40' and the adjustment mechanism.

Figure 5:
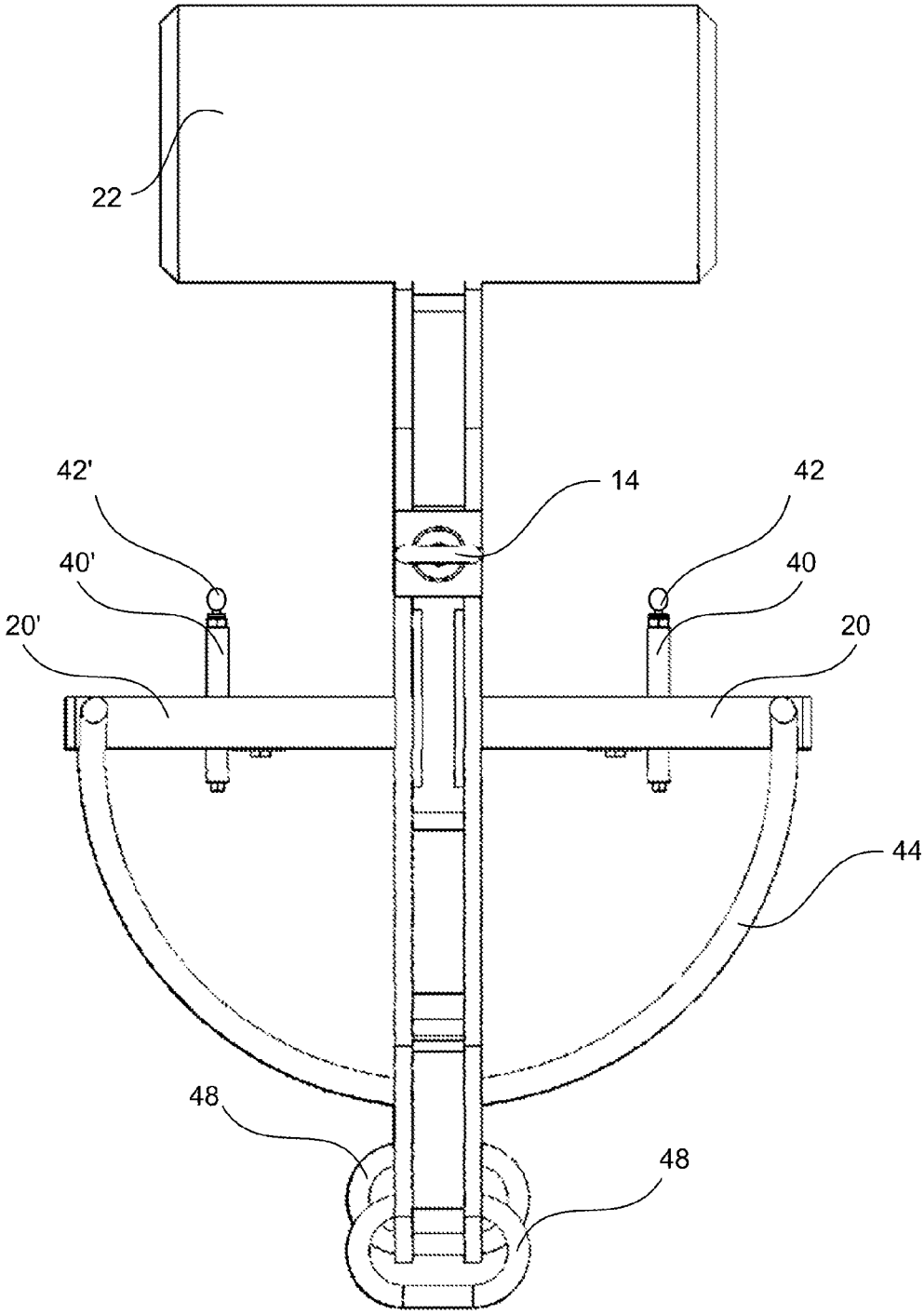
FIG. 5 is a bottom view of the embodiment of FIG. 1.

Also, as shown in FIGS. 3 and 5, the jacking bolts 40, 40' may further include a shoulder tooling bar 42, 42' substantially proximate to the outer surface of impeller 52. Typically, the shoulder tooling bar 42, 42' is made to press fit into the threaded rod of jacking bolts 40, 40' to provide a point contact with impeller 52. In other embodiments, the jacking bolts 40, 40' may include swivel pads on the ends of the jacking bolts 40, 40' substantially proximate to the outer surface of impeller 52. In further embodiments, the jacks 20, 20' are horizontally opposed or the frame 12 and jacks 20, 20' are slidably mounted together for greater adjusting and positioning versatility of impeller jig 10. Other embodiments include jacking bolts 40, 40' with a rounded end to minimize, or eliminate, the jacking bolts 40, 40' from walking on the impeller. The jacking bolts 40, 40' may also be adjustable on the opposed arms. For example, the jacking bolts 40, 40' may include a lateral screw or the like to provide adjustment of the jacking bolts 40, 40'.

In particular embodiments of the present inventions, a positioning weight 22 is affixed adjacent to the lifting eye 14 to generally displace the weight of impeller jig 10 in a given plane. Typically, the positioning weight 22 is located between the vertical centerline and the impeller 52 to move the center of gravity of the impeller jig 10 both upwardly and sufficiently close to the lifting vertical centerline to engage the impeller 52 prior to lifting.

As seen in FIGS. 1-4, the positioning weight 22 may be adjacently affixed above the upper surface of the frame 12. Typically, in such embodiments, the impeller jig 10 is configured to operate a variety of loads, including, but not limited to, substantially heavyweight loads.

As seen in FIG. 7, other embodiments of the present inventions include the positioning weight being affixed substantially co-planar with the upper surface of frame 12. Typically, in these embodiments, the impeller jig 10 is configured to operate a variety of loads, including, but not limited to, substantially intermediate loads.

Other embodiments of positioning weight 22 include a variety of shapes, styles and sizes, including a substantially zero-weight positioning weight 22, as shown in FIG. 8. Typically, in these embodiments, the impeller jig 10 is again configured to operate a variety of loads, including, but not limited to, substantially lightweight loads.

FIG. 10 best illustrates that the general amount of positioning weight 22 is a function of a weight of the impeller jig 10 according to the function: Maximum Applied Force equals $((M)(W_j*G)(Sin(theta)))/(G_h)$; where M is the correcting moment, $W_j$ is the weight of the impeller jig, G is the gauge distance, theta is the desired angle or repose, and $G_h$ is the handle gauge distance.

Figure 11:
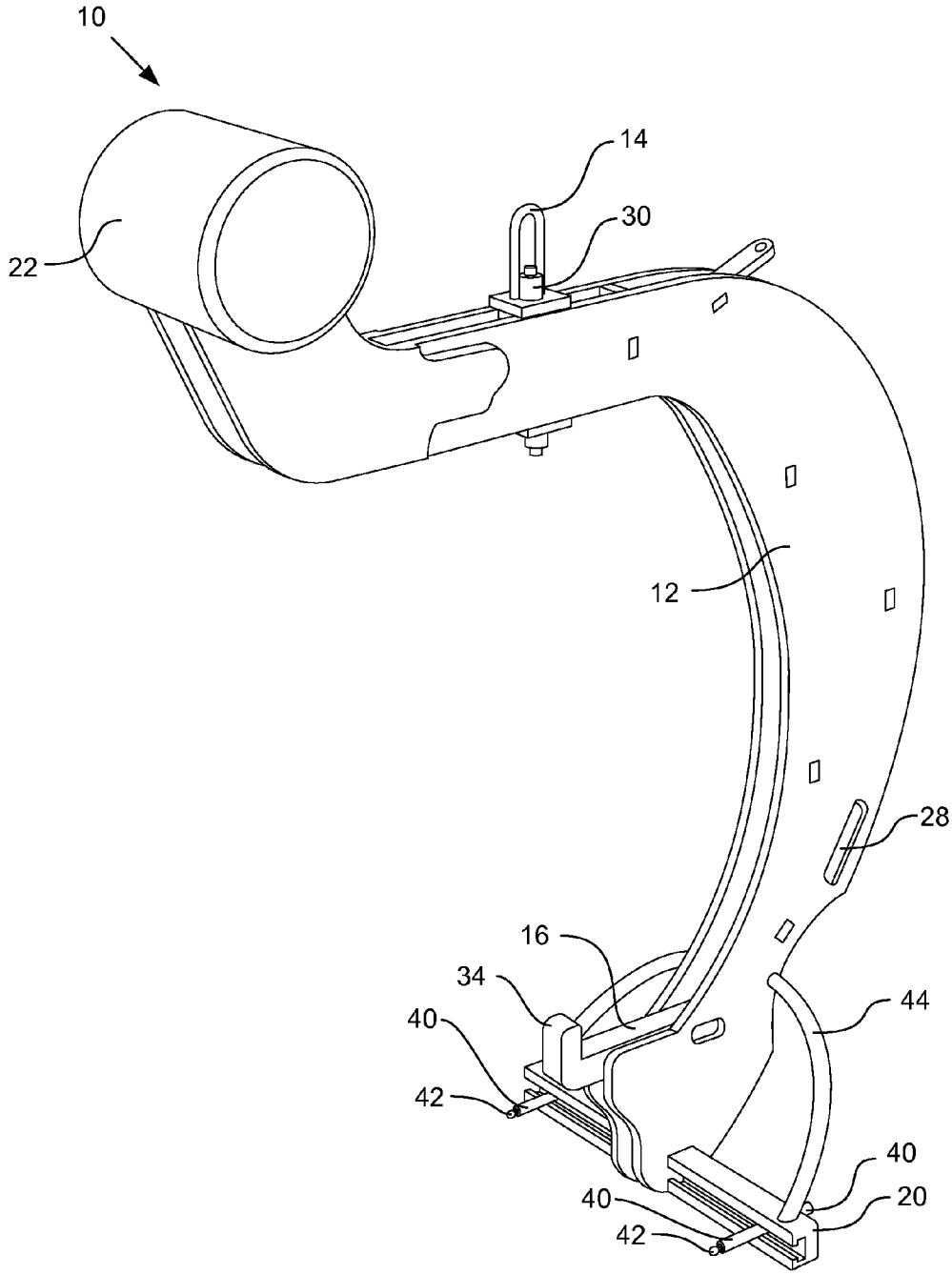
FIG. 11 is a side-perspective view of another embodiment of the impeller jig constructed according to the present inventions.

FIG. 11 shows another embodiment of the jig 10 constructed according to the present inventions. As illustrated, the frame 12 is substantially curved for improved handling and alignment positioning where lifting and positioning of an impeller 10, propeller or a similar load is desired.

In other embodiments, the Maximum Applied Force is a function of maximum human force, for example about forty-five pounds of force, and the desired angle of repose is about five to about fifteen degrees, for example about ten degrees.

Figure 2:
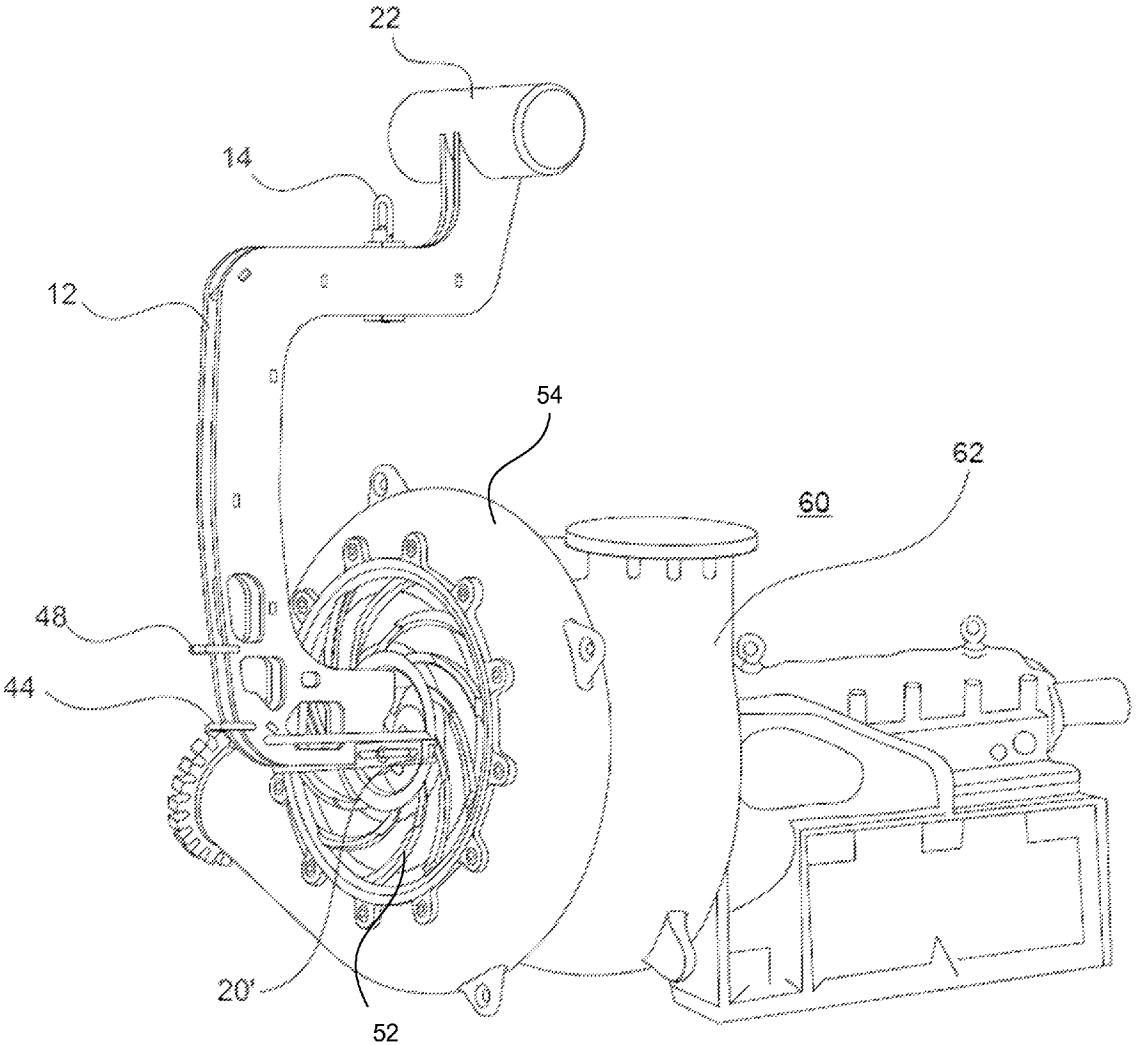
FIG. 2 is a side-perspective view of the embodiment of FIG. 1, where the impeller jig is shown positioning an impeller in one embodiment of a pump within a pump housing assembly.

The impeller jig 10 may further include a plurality of positioners to provide additional mechanical advantage to bring the impeller jig 10 into plane with pump 54, a pump shaft or the like. For example, as illustrated in FIGS. 1 and 2, one embodiment of impeller jig 10 includes a pair of guiding bars 48 affixed to frame 12 adjacent to lifting point 16 and on the opposite side of the frame 12 from the impeller 52 to horizontally guide the impeller jig 10 into plane with pump housing 62 or a pump shaft of the pump assembly 60. Similarly, frame 12 may include a positioning bar 44 adjacent to the lifting point 16 and generally opposite from the impeller 52.

As best seen in FIGS. 1 and 5, the positioning bar 44 may be semi-circular and extend substantially between the opposed jacks 20, 20'. Also, frame 12 may include a plurality of grips 28 to provide additional mechanical advantage or to reduce frame 12 weight and material cost. Other embodiments of positioners include a variety of shapes, styles and sizes to provide mechanical advantage when operating the impeller jig 10.

In some cases, a particular site or neighboring sites may include a plurality of pumps 54 having a variety of impeller constraints. For example, common constraints may include pumps having an impeller dimension that may be unique to the impeller dimensions of the other pumps, or other installation or clearance constraints. Therefore, it may be prudent to include an impeller jig inventory, e.g. any of the jigs 10 previously shown or described, to position any of the unique impeller dimensions in any of the pumps 54. Most typically, such an impeller jig inventory includes a first impeller jig, a second impeller jig, a third impeller jig, and a fourth impeller jig (e.g. any of the jigs 10 previously shown or described), where the impeller jig inventory is generally adapted to install, remove, or otherwise position any of the unique impeller dimensions in any of the pumps 54 at the sites.

In use, impeller jig 10 typically operates as a below-the-hook lifting device for construction, installation, inspection, testing, maintenance, operation and the like of impellers 52 with minimized manhandling and enhanced safety features. Operating the impeller jig 10 typically includes an operator adjusting the impeller jig 10 from the lifting eye 14 into pump 54, or for example, on a pump shaft. Adjusting the impeller jig 10 may include lifting, e.g. raising and lowering the impeller jig 10 along a vertical plane and moving the impeller jig along a horizontal axis, the impeller 52. Additionally, operating the impeller jig 10 includes adjusting the opposed jacking bolts 40, 40' to bring the impeller 52 into a proper plane with pump 54. Further, guiding the impeller jig 10 with the positioners, e.g. any of the positioners shown or described, helps work the impeller 52 into plane or into position with the pump 54.

It should be understood that all modifications and improvements have been deleted herein for the sake of conciseness and readability but are properly within the scope of the following claims.

We claim:

1. An impeller jig for lifting and positioning an impeller having a shaft bore in a pump, said impeller jig comprising:

(a) a frame having at least one positioner, said at least one positioner including at least one grip defined by a cavity in the frame or at least one guiding bar secured on the frame, whereby the at least one positioner is adapted to position the impeller jig with respect to the impeller prior to lifting the impeller;

(b) a lifting aperture attached to the upper end of said frame;

(c) a lifting point attached to an opposed end of said frame opposing the upper end of said frame and adapted to engage the shaft bore of the impeller, said lifting aperture and said lifting point defining a lifting vertical centerline extending from said lifting aperture to said lifting point;

(d) a pair of opposed jacks attached to the opposed end of said frame and spatially separated from the frame, wherein said pair of jacks extend in opposing directions substantially perpendicular from said frame and whereby the pair of opposed jacks are adapted to engage at least two opposed outer surfaces of the impeller adjacent to the shaft bore of the impeller thereby forming a stability triangle with said lifting point; and (e) a positioning weight adjacent to said lifting aperture for transferring the center of gravity of said impeller jig upwardly and sufficiently close to said lifting vertical centerline to permit said impeller jig to be positioned for engaging the impeller by an operator prior to lifting.

2. The apparatus according to claim 1, wherein said positioning weight is located between said lifting vertical centerline and the impeller.

3. The apparatus according to claim 1, wherein the amount of said positioning weight is a function of a weight of said impeller jig according to the following function Maximum Applied Force equals $((M)(W_j*G)(Sin(theta)))/(G_h)$ where M is the correcting moment, $W_j$ is the weight of the impeller jig, G is the gauge distance, theta is the desired angle or repose, and $G_h$ is the handle gauge distance.

4. The apparatus according to claim 3, wherein the Maximum Applied Force is about forty-five pounds and the angle of repose is about ten degrees.

5. The apparatus according to claim 1, including a pair of guiding bars located on the opposite side of the frame from the impeller for positioning the impeller jig with respect to the impeller prior to lifting the impeller wherein one of said pair of guiding bars is located near said lifting point and the other of said pair of guiding bars is located above said lifting point.

6. The apparatus according to claim 1, further including a positioning bar located adjacent to said lifting point and on the opposite side of the frame from the impeller, whereby said positioning bar horizontally positions the lifted impeller with respect to the pump shaft bore.

7. The apparatus according to claim 6, wherein said positioning bar is generally semi-circular and extends from one of said pair of opposed jacks located adjacent to said lifting point to the other of said pair of opposed jacks.

8. The apparatus according to claim 1, wherein said frame is formed by a semi-box construction.

9. The apparatus according to claim 8, wherein said semi-box construction includes a pair of parallel side plates attached to one another by tie-ins to resist buckling, said pair of parallel side plates forming said lifting point.

10. The apparatus according to claim 1, wherein the lifting aperture is a lifting eye.

11. The apparatus according to claim 10, wherein said lifting eye includes a hoist ring and a fastener for attaching said hoist ring to said frame.

12. The apparatus according to claim 11, wherein said hoist ring is a swivel hoist ring.

13. The apparatus according to claim 11, wherein said fastener is an adjustable position fastener for moving said lifting vertical centerline.

14. The apparatus according to claim 13, further including a marking plate adjacent to said adjustable position fastener for indicating pre-determined positions to move said hoist ring in the vertical lifting plane of said impeller jig for specific impellers prior to lifting.

15. The apparatus according to claim 1, wherein the opposed end of said frame adjacent to said lifting point further includes a stationary pivot point.

16. The apparatus according to claim 15, wherein said stationary pivot point and said pair of opposed jacks located adjacent to said lifting point are adapted to position the vertical plane of the impeller substantially perpendicular to the axis of the pump shaft bore.

17. An impeller jig for lifting and positioning an impeller having a shaft bore in a pump, said impeller jig comprising:

(a) a frame;

(b) a lifting aperture attached to the upper end of said frame;

(c) a lifting point attached to an opposed end of said frame opposing the upper end of said frame and adapted to engage the shaft bore of the impeller, said lifting aperture and said lifting point defining a lifting vertical centerline extending from said lifting aperture to said lifting point; and (d) a pair of opposed jacks attached to the opposed end of said frame and spatially separated from the frame and including a pair of opposed arms and a pair of jacking bolts, wherein said pair of jacks extend in opposing directions substantially perpendicular from said frame and whereby the pair of opposed jacks are adapted to engage at least two opposed outer surfaces of the impeller adjacent to the shaft bore of the impeller thereby forming a stability triangle with said lifting point and wherein said pair of opposed jacks are adjustable with respect to the lifting vertical centerline of said impeller jig.

18. The apparatus according to claim 17, wherein said pair of opposed arms are adapted to provide lateral adjustment of said pair of jacking bolts with respect to the lifting vertical centerline.

19. The apparatus according to claim 18, wherein said pair of opposed arms are slotted to provide lateral adjustment of said pair of jacking bolts.

20. The apparatus according to claim 17, wherein said pair of jacking bolts further include a shoulder tooling bar on the ends of said jacking bolts proximate to the outer surfaces of the impeller.

* * * * *